US009478386B2

(12) United States Patent
Fu

(10) Patent No.: US 9,478,386 B2
(45) Date of Patent: Oct. 25, 2016

(54) INTEGRATED GAS DISCHARGE TUBE AND PREPARATION METHOD THEREFOR

(71) Applicant: Shenzhen Bencent Electronics Co., Ltd., Guangdong (CN)

(72) Inventor: Meng Fu, Guangdong (CN)

(73) Assignee: Shenzhen Bencent Electronics Co., Ltd. (CN)

( * ) Notice: Subject to any disclaimer, the term of this patent is extended or adjusted under 35 U.S.C. 154(b) by 0 days.

(21) Appl. No.: 14/779,082

(22) PCT Filed: Feb. 13, 2014

(86) PCT No.: PCT/CN2014/072010

§ 371 (c)(1),
(2) Date: Sep. 22, 2015

(87) PCT Pub. No.: WO2014/146523

PCT Pub. Date: Sep. 25, 2014

(65) Prior Publication Data

US 2016/0049276 A1 Feb. 18, 2016

(30) Foreign Application Priority Data

Mar. 22, 2013 (CN) ..... 2013 1 0095077

(51) Int. Cl.

| | |
|---|---|
| ***H01J 17/49*** | (2012.01) |
| ***H01J 17/04*** | (2012.01) |
| ***H01J 19/02*** | (2006.01) |
| ***H01J 19/28*** | (2006.01) |
| ***H01J 19/54*** | (2006.01) |
| ***H01J 21/00*** | (2006.01) |
| ***H01J 21/36*** | (2006.01) |
| ***H01J 9/02*** | (2006.01) |
| ***H01J 9/26*** | (2006.01) |
| ***H01J 17/18*** | (2012.01) |

(52) U.S. Cl.

CPC ..... *H01J 17/04* (2013.01); *H01J 9/02* (2013.01); *H01J 9/265* (2013.01); *H01J 17/183* (2013.01); *H01J 19/02* (2013.01); *H01J 19/28* (2013.01); *H01J 19/54* (2013.01); *H01J 21/00* (2013.01); *H01J 21/36* (2013.01)

(58) Field of Classification Search

CPC ..... H01J 11/12
USPC ..... 313/581, 585
See application file for complete search history.

(56) References Cited

U.S. PATENT DOCUMENTS

| | | | |
|---|---|---|---|
| 5,726,854 | A | 3/1998 | Maki et al. |
| 2002/0008952 | A1 | 1/2002 | Shin |

FOREIGN PATENT DOCUMENTS

| | | | |
|---|---|---|---|
| CN | 202502978 | U | 10/2012 |
| CN | 103441053 | A | 12/2013 |

*Primary Examiner* — Vip Patel
(74) *Attorney, Agent, or Firm* — Terrance J. Edwards; TechLaw Ventures, PLLC

(57) ABSTRACT

Provided is an integrated gas discharge tube. In the integrated gas discharge tube, the structure of the gas discharge tube is regulated into an upper cover and an insulative base, and the internal side surface and the external side surface of the bottom surface of the insulative base are respectively subject to electrode integration, so that the discharge effect of the gas discharge tube is effectively increased and the preparation process and the preparation flow of a multi-terminal-to-ground gas discharge tube are greatly simplified so as to greatly simplify the preparation process and to realize batch production and high integration of the gas discharge tube. Also provided is a preparation method for an integrated gas discharge tube.

17 Claims, 7 Drawing Sheets

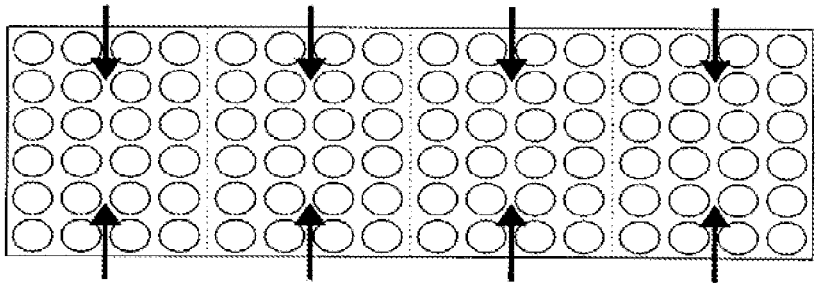

▲Static state of integrated gas discharge tube

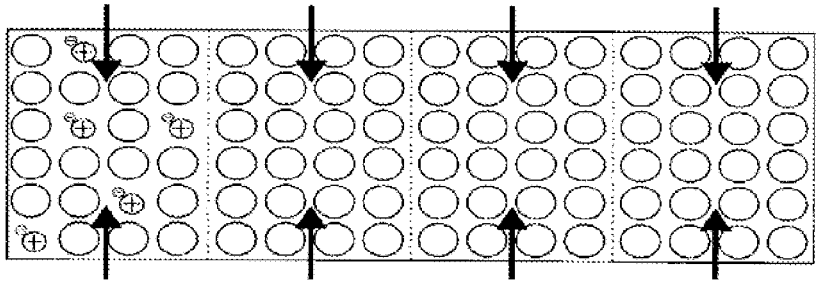

▲Generation of gas electrons and gas ions by single gas discharge tube upon lighting

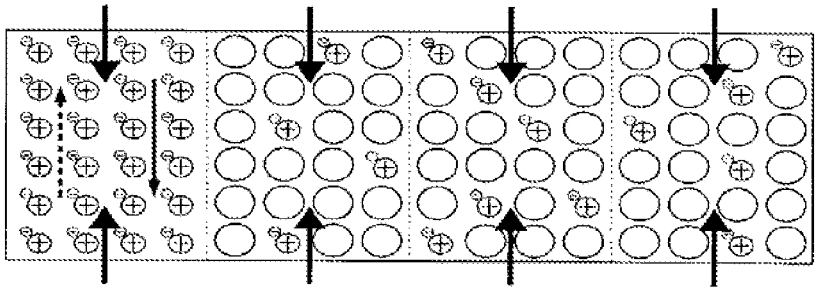

▲Transferring of gas electrons and ions to other gas discharge tubes

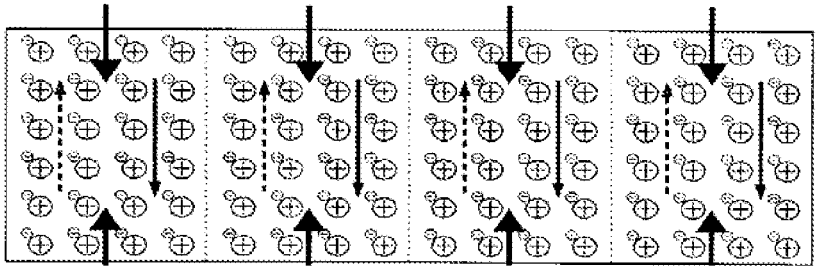

▲Other gas discharge tubes are triggered, electron and ion flows are generated to ignite and breakdown the whole cavity, to release lighting current Legend: Gas molecules; Gas electron; Gas ions; Gas electron flow; Gas ion flow

Figure 10

INTEGRATED GAS DISCHARGE TUBE AND PREPARATION METHOD THEREFOR

CROSS-REFERENCE TO RELATED APPLICATIONS

The present disclosure claims priority to Chinese patent application No. 201310095077.7, entitled "Integrated Gas Discharge Tube and Manufacturing Method Therefor" and filed on Mar. 22, 2013 with the Chinese Patent Office, the disclosure of which is incorporated therein by reference in its entirety.

TECHNICAL FIELD

The present disclosure relates to discharge tube technologies, particularly to an integrated gas discharge tube and a manufacturing method therefor.

BACKGROUND

The traditional diode gas discharge tube includes two metal electrodes, two solders, and one ceramic insulative tube covered with a metallization layer, which are sealedly connected to form a discharge gap, where the electrodes are coated with a cathode emission material, and the ceramic insulative tube is provided with two or more trigger conductive strips. As shown in FIG. 1, the traditional diode gas discharge tube includes two metal electrodes 1, two solders 2, and one ceramic insulative tube 3 covered with a metallization layer, where the ceramic insulative tube 3 is provided with at least two conductive strips 31.

A process for manufacturing the traditional diode gas discharge tube includes that:

a bar or sheet material is mechanically stamped, then chamfered, polished and cleaned, to form the metal electrodes;

ceramic particles are mixed with an organic matter to form a slurry, which is subjected to dry pressing or injection moulding and to low-temperature binder removal, then sintered at a high temperature of 1400°, and smoothened, to form the ceramic insulative tube;

the ceramic insulative tube is subjected to screen printing, low-temperature curing and sintering at about 1300°, and then plated with nickel, to form the metallization layer;

a solder alloy is formed by smelting at a high temperature of about 1200° and then annealed to form a block-shaped alloy, which is in turn laminated and stamped to form the solders;

the trigger conductive strips are formed by drawing with a pencil; and the electrodes are cleaned and coated with the cathode emission material, and then are assembled with the metallized ceramic insulative tube and the solders in a mold, and the assembled electrodes, metallized ceramic insulative tube and solders are placed in a vacuum seal furnace, which is subjected to gas discharging to form vacuum therein, is injected with a gas, and is raised to a temperature of about 850°, so that the electrodes, the metallized ceramic insulative tube and the solders are brazing welded at a high temperature, and are sealedly connected, thus a semi-finished product is formed after cooling, and the semi-finished product is aged, cleaned, plated, printed, and tested to obtain the resultant qualified product.

The gas discharge tube with the traditional structure has a poor discharge effect, and is disadvantageous in manufacturing for its complicated structure. For example:

the raw material used for manufacturing the traditional gas discharge tube need be processed in many steps, and therefore causes a high cost;

the metallized ceramic insulative tube is twice subjected to the high-temperature sintering at 1000° or higher, and the solders are subjected to the high-temperature smelting at 1000° or higher, so that the energy consumption for the raw materials is high; in addition, the resultant product is obtained by the sealed connecting at a high temperature of about 850°, therefore, all these three times of high-temperature sintering in the manufacturing process are disadvantageous for energy saving and emission reduction;

the numerous steps in the manufacturing process for the traditional gas discharge tube require for large investment in equipment and manpower, resulting in a high cost;

it is difficult to achieve the miniaturization and integration of the product; for example, to manufacture a multipolar integrated gas discharge tube, the raw material as required and the cost are increased by times, illustratively, as shown in FIG. 2, a gas discharge tube with four grounding ends that is manufactured by the traditional gas discharge tube manufacturing process typically includes 13 components, i.e. five electrodes 4, six solders 5, and two ceramic insulative tube 6 provided with a metallization layer 61; and the numerous steps in the manufacturing process for the traditional gas discharge tube and the poor precision of processing the raw material lead to significant fluctuation of parameters of the gas discharge tube.

SUMMARY OF THE INVENTION

An object of the present disclosure is to provide an integrated gas discharge tube, which can improve the discharge effect, significantly simplify the manufacturing process and flow, and improve the degree of integration.

Furthermore, a method for manufacturing the integrated gas discharge tube is also provided, and the method includes simple processes, allows for mass production of the integrated gas discharge tubes, and is favorable for the high integration of the integrated gas discharge tube.

An integrated gas discharge tube includes: an upper cover, and an insulative base with a bottom integrated with a plurality of electrodes, where the insulative base has a cavity structure, the upper cover and the insulative base are connected in a sealed manner to form a cavity, the bottom includes an inner surface and an outer surface, at least one electrode is disposed on the inner surface, at least two electrodes are disposed on the outer surface, and at least one of the at least two electrodes on the outer surface of the bottom is correspondingly connected electrically with at least one of the at least one electrode on the inner surface of the bottom.

Preferably, the insulative base has a layered structure and includes a bottom, at least one cavity layer on the bottom, and a sealing layer on the cavity layer, and the sealing layer includes a solder layer for brazing welding at a high temperature or a metal layer for parallel welding.

Preferably, at least one of the at least one cavity layer is provided with at least one conductive strip extending in a vertical direction and/or a transverse direction.

Preferably, the insulative base has an integral structure and includes the bottom, a cavity body formed integrally with the bottom, and a sealing layer on the cavity body, and the sealing layer includes a solder layer for brazing welding at a high temperature or a metal layer for parallel welding.

Preferably, the cavity body is provided with at least one conductive strip extending in a vertical direction and/or a transverse direction.

Preferably, the upper cover is conductive, and at least one electrode on the outer surface is electrically connected with the conductive upper cover.

Preferably, each electrode disposed on the outer surface includes at least one through hole which passes through the bottom and filled with conductive material, and at least one of the electrodes disposed on the outer surface is electrically connected with the conductive upper cover via the conductive material filled in the through hole.

Preferably, at least one of the electrodes disposed on the outer surface is electrically connected with the corresponding electrode disposed on the inner surface via the conductive material filled in the through hole.

Preferably, the through hole filled with the conductive material is substituted by a conductive layer.

Preferably, the upper cover is insulative, at least one common electrode for the electrodes disposed on the inner surface is disposed at a designated position on the cavity structure of the insulative base, and at least one of the electrodes disposed on the outer surface is electrically connected with the common electrode.

Preferably, the upper cover is insulative, and at least two electrodes are disposed on the inner surface and are electrically connected with the at least two electrodes disposed on the outer surface, respectively, to form at least two paired-electrodes.

Preferably, the insulative base further includes a metal ring on the solder layer.

In an optional implementation, at least one of the electrodes on the outer surface of the bottom extends to a side wall of the insulative base.

A method for manufacturing an integrated gas discharge tube includes: preparing an insulative slurry and casting the insulative slurry to form a green sheet; forming a conductive pole or a conductive layer on the green sheet; printing conductive material and/or cathode emission material on the green sheet which is used as a bottom of the integrated gas discharge tube; laminating a plurality of the green sheets and sintering and electroplating the laminated green sheets, to form an insulative base of the integrated gas discharge tube; and sealedly connecting an upper cover with the insulative base to form a sealed cavity and filling the cavity with inert gas.

Preferably, forming the conductive pole on the green sheet includes: punching the green sheet to form a through hole therein; and filling conductive material in the through hole.

Preferably, forming the conductive layer on the green sheet includes: burying or printing the conductive material on a surface of the green sheet.

An embodiment of the present disclosure further provides a gas discharge tube which includes: a sealed cavity, which is configured to store inert gas, formed by a cover and an insulative cavity structure that are sealedly connected, wherein at least one first electrode is attached to an inner wall of the sealed cavity, at least one second electrode is attached to an outer surface of the sealed cavity, and at least one of the at least one second electrode is electrically connected to at least one of the at least one first electrode.

In an optional implementation, the cover is made of conductive material, and the at least one first electrode attached to the inner wall of the sealed cavity includes:

at least one first electrode attached to an inner surface of the insulative cavity structure;

the at least one second electrode attached to the outer surface of the sealed cavity includes:

at least one second electrode attached to an outer surface of the insulative cavity structure; and at least one third electrode is attached at the outer surface of the insulative cavity structure and is electrically connected with the cover.

In an optional implementation, the electrical connection of the at least one third electrode to the cover refers to that:

the at least one third electrode is electrically connected to the cover via the conductive material filled in a through hole.

In an optional implementation, the electrical connection of the at least one second electrode to the at least one first electrode refers to that:

the at least one second electrode is electrically connected to the at least one first electrode via the conductive material filled in a through hole.

In an optional implementation, the insulative cavity structure comprises a sealing layer, a bottom layer and at least one cavity layer between the sealing layer and the bottom layer, wherein the sealing layer includes a solder layer for brazing welding at a high temperature or a metal layer for parallel welding.

Unlike in the prior art, the structure of the integrated gas discharge tube in the present disclosure is designed to include an upper cover and an insulative base, and electrodes are disposed at each of the inner and outer surfaces of the insulative base, so that the discharge effect of the gas discharge tube is improved significantly, and the manufacturing process and flow for a gas discharge tube with multiple ends for grounding is substantially simplified. Thus, the simplification of the manufacturing process enables the mass production and high integration of the gas discharge tube.

BRIEF DESCRIPTION OF THE DRAWINGS

To illustrate technical schemes in the embodiments of the present disclosure and the prior art more clearly, accompanying drawings used for describing the embodiments or the prior art are briefly introduced below. Obviously, the accompanying drawings show merely some embodiments of the present disclosure, and other drawings may be derived from the accompanying drawings by those skilled in the art without creative work.

FIG. 10 is a schematic diagram showing discharge principles of the integrated gas discharge tube according to an embodiment of the present disclosure.

DETAILED DESCRIPTION OF THE EMBODIMENTS

Figure 1:
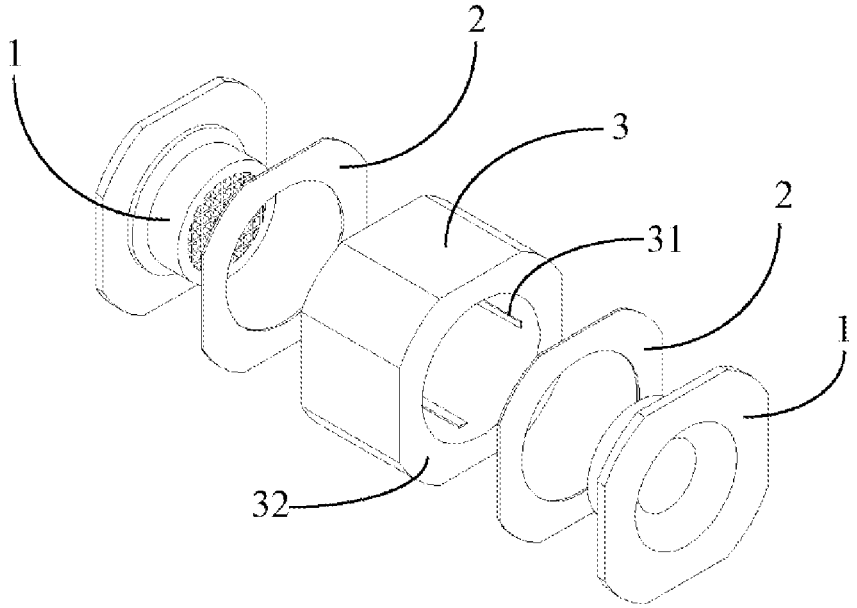
FIG. 1 is a schematic diagram showing a structure of a diode gas discharge tube in the prior art.
Figure 2:
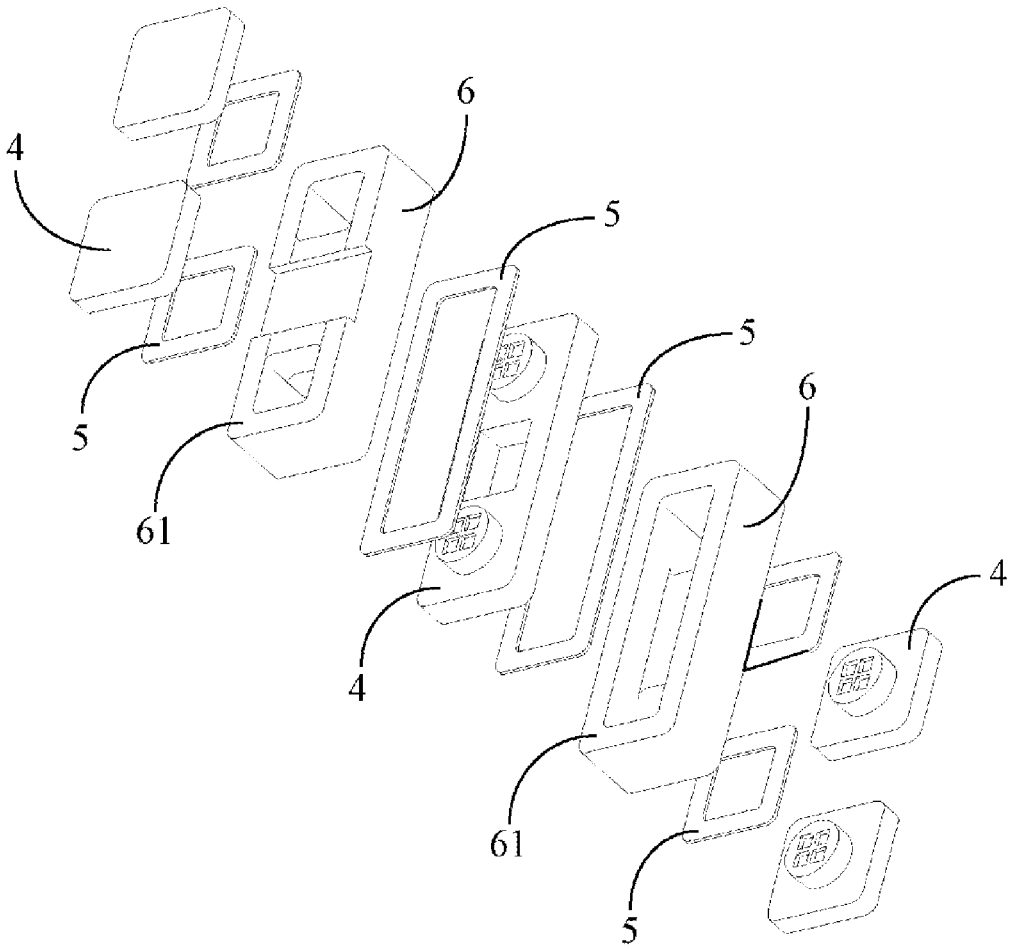
FIG. 2 is a schematic diagram showing a structure of a gas discharge tube with four grounding ends in the prior art.

To make technical problems to be solved, technical schemes and beneficial effects of the present disclosure more apparent, the present disclosure is described below in combination with the accompanying drawings and embodiments.

A preferred embodiment of the present disclosure provides an integrated gas discharge tube which includes: an upper cover, and an insulative base with a bottom integrated with a plurality of electrodes, where the insulative base has a cavity structure, and the upper cover and the insulative base are connected in a sealed manner to form a cavity which is configured to be filled with inert gas. Herein, the upper cover may be electrically conductive or insulative.

When being electrically conductive, the upper cover can be used as a common electrode for the plurality of electrodes at the bottom of the insulative base, and in this case, at least one electrode on the outer surface (i.e. the lower surface) of the bottom of the insulative base is electrically connected with the conductive upper cover.

When the upper cover is electrically insulative, at least one common electrode for the plurality of electrodes at the bottom of the insulative base may be disposed at any suitable position in the cavity structure of the insulative base, for example, at least one common electrode is arranged on a side wall of the cavity structure, or at least one electrically conductive layer is arranged as the common electrode at a position inside the cavity structure. In this case, at least one electrode on the outer surface of the bottom of the insulative base is electrically connected with the common electrode.

When the upper cover is electrically insulative, it is possible that a common electrode for the plurality of electrodes at the bottom of the insulative base is absent in the cavity structure of the insulative base, and in this case, at least two electrodes are disposed on the outer surface of the bottom of the insulative base and are electrically connected with at least two electrodes disposed on the inner surface (i.e. the upper surface) of the bottom of the insulative base, respectively, to form at least two paired-electrodes. For example, to form two paired-electrodes, two electrode X1 and X2 are disposed on the outer surface of the bottom of the insulative base, two electrodes Y1 and Y2 are disposed on the inner surface of the bottom of the insulative base, the electrodes X1 and Y1 are electrically connected to form a first paired-electrode, and the electrodes X2 and Y2 are electrically connected to form a second paired-electrode, so that discharge is conducted between the first paired-electrode and the second paired-electrode.

In the present embodiment, the plurality of electrodes at the bottom of the insulative base share the same sealed cavity storing inert gas. The electrode on the outer surface of the bottom of the insulative base and the electrode on the inner surface of the bottom of the insulative base, which are electrically connected, belong to one gas discharge tube in theory. Considering that a plurality of electrodes provided on the inner surface of the bottom of the insulative base are present within the cavity structure of the integrated gas discharge tube, and are electrically connected with a plurality of electrodes provided on the outer surface of the bottom of the insulative base, a plurality of gas discharge tubes are formed and share the same sealed cavity, so that when the integrated gas discharge tube is applied with an overvoltage, discharge is conducted in the integrated gas discharge tube, and exchanging and transferring of gas, primary electrons, gas electrons and gas ions is implemented by the plurality of gas discharge tubes upon the discharge. Illustratively, referring to FIG. 10 which is a schematic diagram showing discharge principles of the integrated gas discharge tube according to an embodiment of the present disclosure, through the transferring of electrons and ions in the same cavity, the plurality of gas discharge tubes ignite the whole cavity and trigger one another to operate simultaneously, so that more intensive lighting or a higher overvoltage or overcurrent can be released through the integrated gas discharge tube, and the possibility of damaging the individual one(s) of the plurality of gas discharge tubes is decreased.

Further, in the present embodiment, the common sealed cavity can ensure consistency of operations of the plurality of gas discharge tubes hit by lighting or applied by an overvoltage, and therefore shifting from a common mode to a differential mode due to the inconsistency between discharge tubes can be effectively avoided, thereby protecting subsequent circuits from damages.

Reference is made below to FIGS. 3 to 9, to illustrate the case where the upper cover is conductive and functions as a common electrode for the plurality of electrodes at the bottom of the insulative base, and how to form electrical connection relationships between the plurality of electrodes at the bottom of the insulative base and the common electrode. Further, in light of the following illustrative description on some specific structures, a technical scheme that "when the upper cover is electrically insulative, at least one common electrode for the plurality of electrodes at the bottom of the insulative base may be disposed at any suitable position in the cavity structure of the insulative base" and a technical scheme that "when the upper cover is electrically insulative, it is possible that a common electrode for the plurality of electrodes at the bottom of the insulative base is absent in the cavity structure of the insulative base, and in this case, at least two electrodes are disposed on the outer surface of the bottom of the insulative base and are electrically connected with at least two electrodes disposed on the inner surface of the bottom of the insulative base, respectively, to form at least two paired-electrodes" can readily occur to those skilled in the art, and therefore will not be described again herein.

Figure 3:
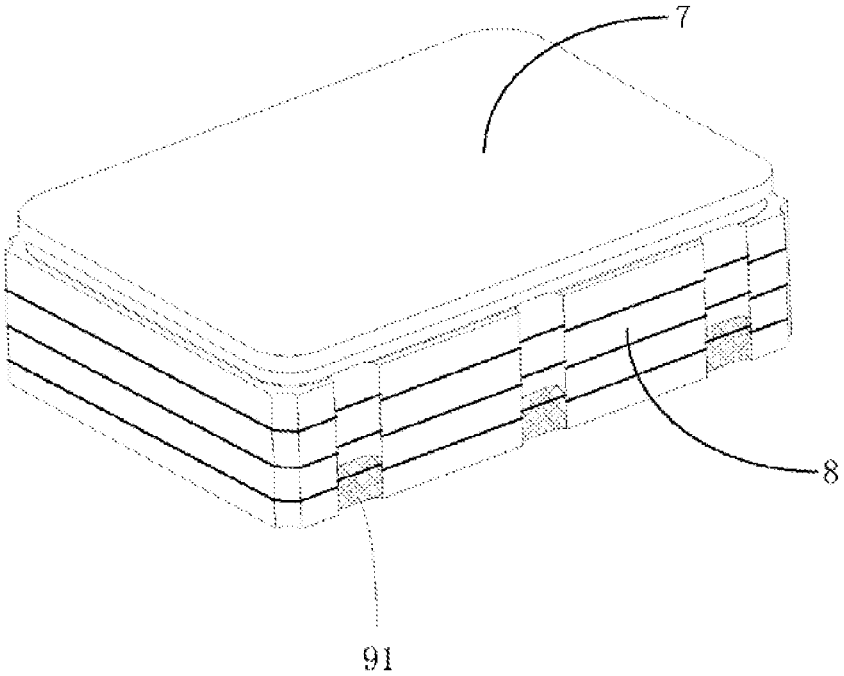
FIG. 3 is a schematic diagram showing a structure of an integrated gas discharge tube according to a preferred embodiment of the present disclosure.

FIG. 3 is a schematic diagram showing a structure of the integrated gas discharge tube according to a preferred embodiment of the present disclosure.

Figure 4:
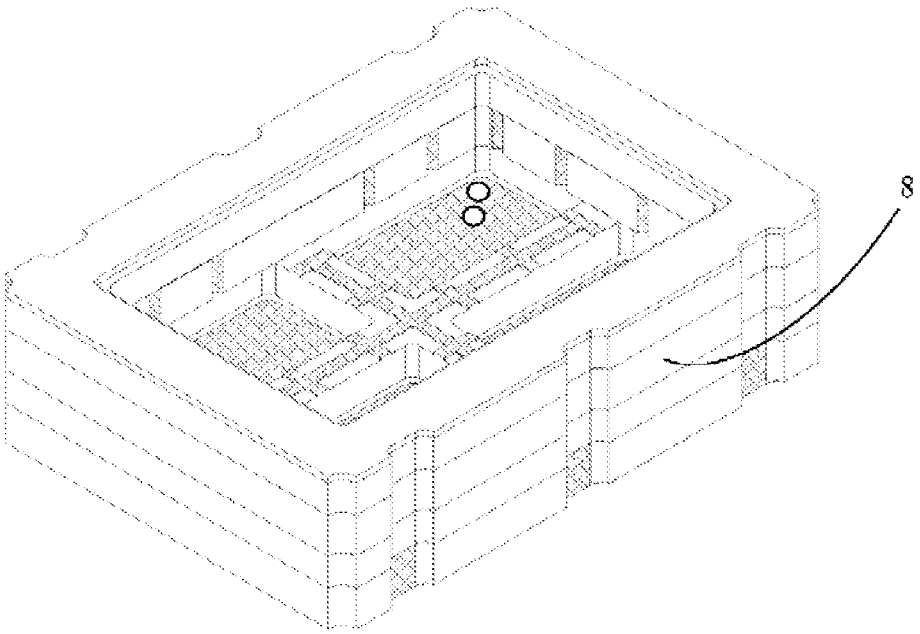
FIG. 4 is a top view of a cavity structure of an insulative base shown in FIG. 3 according to a preferred embodiment of the present disclosure.
Figure 8:
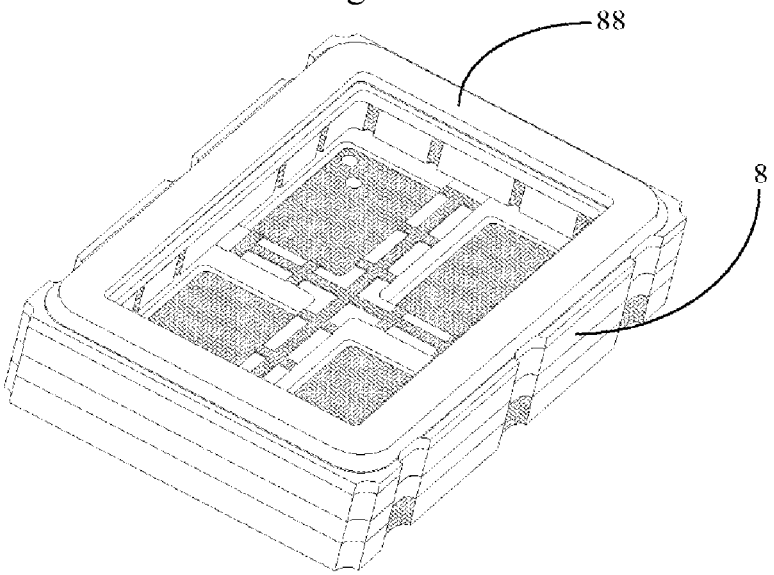
FIG. 8 is a top view of a cavity structure of the insulative base shown in FIG. 3 according to another preferred embodiment of the present disclosure.

The integrated gas discharge tube includes a conductive upper cover 7, and an insulative base 8 with a bottom integrated with a plurality of electrodes, where the insulative base 8 has a cavity structure (as shown in FIG. 4 or 8, for example) so that a sealed cavity is formed between the conductive upper cover 7 and the insulative base 8. The insulative base 8 may have an integral structure or a layered structure.

The insulative base 8 is made of ceramic or any other suitable insulative material.

The conductive upper cover 7 may be integrally made of conductive material, or can be formed by a conductive layer enveloping an insulative material.

Figure 7:
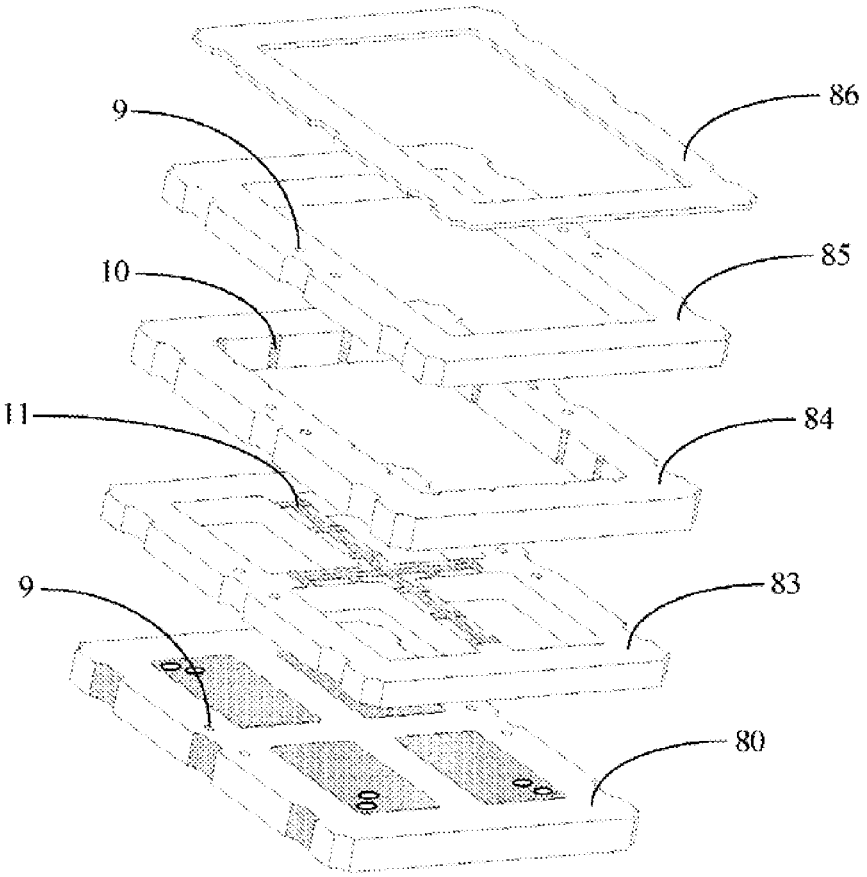
FIG. 7 is a schematic diagram showing a layered structure of the insulative base shown in FIG. 4 according to the preferred embodiment of the present disclosure.

In a first embodiment of the disclosure, the insulative base 8 has a layered structure, including a bottom integrated with a plurality of discharge electrodes, at least one cavity layer on the bottom, and a solder layer on the cavity layer. For example, as shown in FIG. 7, the layered structure of the insulative base 8 includes a bottom 80 integrated with a plurality of discharge electrodes, three cavity layers (for example, a cavity layer 83, a cavity layer 84 and a cavity layer 85, where the top surface of the uppermost cavity layer 85 is provided with a metallization layer) on the bottom 80, and a solder layer 86 above these three cavity layers (for example, the cavity layers 83, 84 and 85). At least one of the cavity layers is provided with at least one conductive strip (which is in a semi-cylindrical shape, for example) extending in a vertical direction and/or a transverse direction, for example, as shown in FIG. 7, the cavity layer 84 is provided with a plurality of conductive strips 10 extending in the vertical direction, and the cavity layer 83 is provided with a plurality of conductive strips 11 extending in the transverse direction. The conductive upper cover 7 is connected to the solder layer 86 in a sealed manner to form a sealed cavity. Illustratively, the solder layer is used for brazing welding at a high temperature, that is, after the insulative base is metalized, the metal on the insulative base and the upper cover are brazing welded at a high temperature by using the solder. Alternatively, the solder layer is substituted by a metal layer for parallel welding, that is, after the insulative base is metalized, a metal is welded to the insulative base and used for parallel welding with the upper cover. It should be appreciated by those skilled in the art that there may be one or more cavity layers on the bottom 80 of the insulative base 8 in the first embodiment, and the sealed cavity as formed is configured to receive inert gas.

Figure 5:
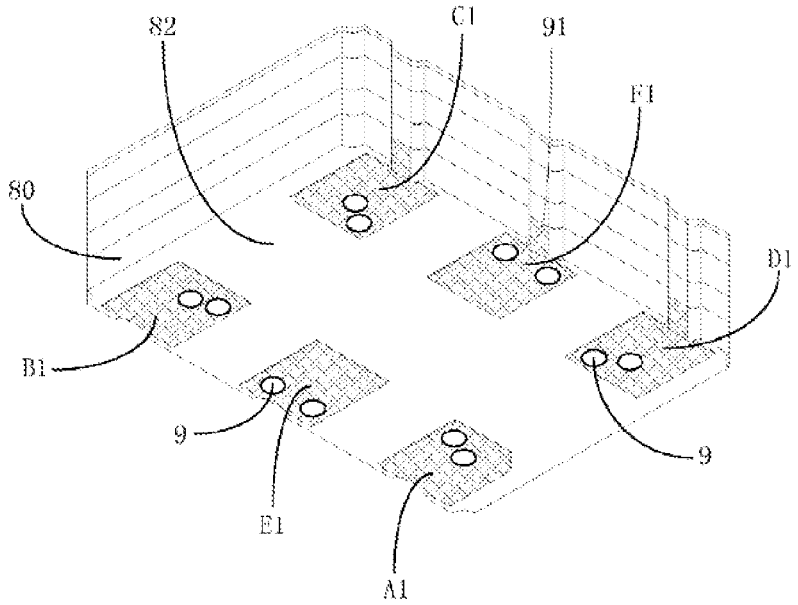
FIG. 5 is a schematic diagram showing a structure of an outer surface of the bottom of an integrated electrode layer of the insulative base shown in FIG. 4 according to the preferred embodiment of the present disclosure.

In a variant of the embodiment, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

Figure 9:
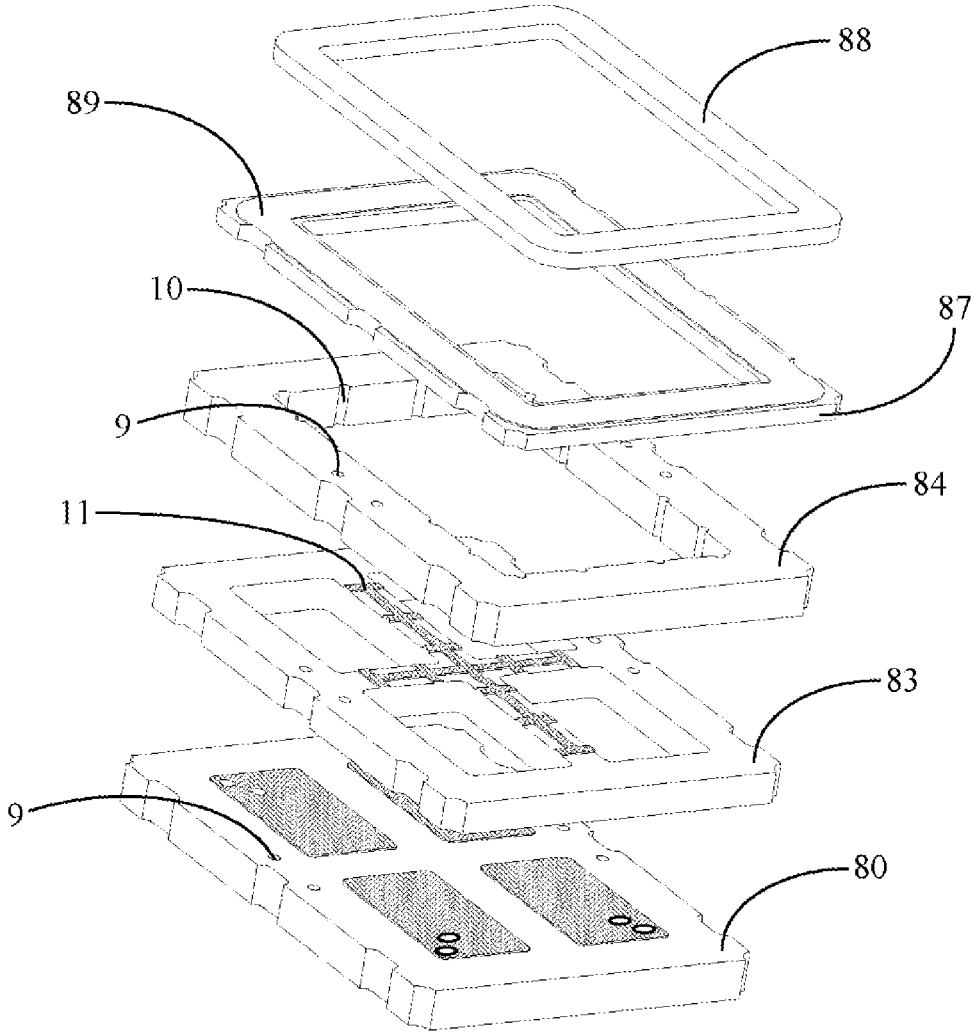
FIG. 9 is a schematic diagram showing a layered structure of the insulative base shown in FIG. 8 according to the another preferred embodiment of the present disclosure.

In a second embodiment, the insulative base 8 has a layered structure, including a bottom integrated with a plurality of discharge electrodes, at least one cavity layer on the bottom, a solder layer on the cavity layer, and a metal ring on the solder layer. For example, as shown in FIG. 9, the layered structure of the insulative base 8 includes a bottom 80 integrated with a plurality of discharge electrodes, three cavity layers (for example, a cavity layer 83, a cavity layer 84 and a cavity layer 87) on the bottom 80, a solder layer 89 on the top surface of the uppermost cavity layer 87, and a metal ring 88 on the solder layer 89. At least one of the cavity layers is provided with at least one conductive strip (which is in a semi-cylindrical shape, for example) extending in a vertical direction and/or a transverse direction, for example, as shown in FIG. 9, the cavity layer 84 is provided with a plurality of conductive strips 10 extending in the vertical direction, and the cavity layer 83 is provided with a plurality of conductive strips 11 extending in the transverse direction. The conductive upper cover 7 is connected to the metal ring 88 in a sealed manner to form a sealed cavity. Illustratively, the solder layer is used for brazing welding at a high temperature, that is, after the insulative base is metalized, the metal on the insulative base and the upper cover are brazing welded together at a high temperature by using the solder. Alternatively, the solder layer is substituted by a metal layer for parallel welding, that is, after the insulative base is metalized, a metal is welded to the insulative base and used for parallel welding with the upper cover. It should be appreciated by those skilled in the art that there may be one or more cavity layers on the bottom 80 of the insulative base 8 in the first embodiment, and the sealed cavity as formed is configured to receive inert gas.

In a variant of the embodiment, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

In a third embodiment, the insulative base 8 has an integral structure (not shown), and includes a bottom, a cavity body and a solder layer which are integrally formed, where the bottom is integrated with a plurality of discharge electrodes, the solder layer is on the cavity body, and the cavity body is provided with at least one conductive strip (which is in a semi-cylindrical shape, for example) extending in a vertical direction and/or a transverse direction. The conductive upper cover 7 is sealed on the solder layer to form a sealed cavity, which is configured to receive inert gas.

In a variant of the embodiment, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

In a fourth embodiment, the insulative base 8 has an integral structure (not shown), and includes a bottom, a cavity structure, a solder layer and a metal ring which are integrally formed, where the bottom is integrated with a plurality of discharge electrodes, the solder layer is on the cavity structure, the cavity structure is provided with at least one conductive strip (which is in a semi-cylindrical shape, for example) extending in a vertical direction and/or a transverse direction, and the metal ring is on the solder layer. The conductive upper cover 7 is sealed on the solder layer to form a sealed cavity, which is configured to receive inert gas.

In a variant of the embodiment, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

Illustratively, the bottom 80 of the insulative base 8 is described below.

FIG. 5 is a schematic diagram showing a structure of an outer surface of the bottom of an integrated electrode layer of the insulative base shown in FIG. 4 according to the preferred embodiment of the present disclosure.

At least two electrodes are integrated on the outer surface of the bottom 80 of the insulative base 8. As shown in FIG. 5, six electrodes, i.e. electrodes A1, B1, C1, D1, E1 and F1, are illustratively integrated on the outer surface 82 of the bottom 80. In some other embodiments of the present disclosure, another suitable number of electrodes, such as 2, 3, 4, 5, 7, 8 or 9 electrodes, may be integrated on the outer surface 82 of the bottom 80.

Figure 6:
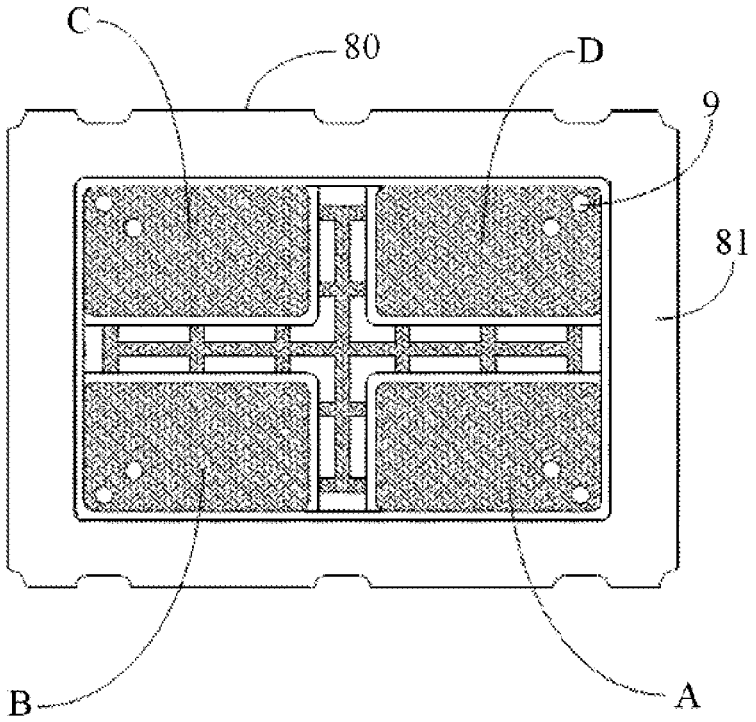
FIG. 6 is a schematic diagram showing a structure of an inner surface of the bottom of the integrated electrode layer of the insulative base shown in FIG. 4 according to the preferred embodiment of the present disclosure.

FIG. 6 is a schematic diagram showing a structure of an inner surface of the bottom of the integrated electrode layer of the insulative base shown in FIG. 4 according to the preferred embodiment of the present disclosure.

At least one electrode is integrated on the inner surface of the bottom 80 of the insulative base 8. As shown in FIG. 6, four electrodes, i.e. electrodes A, B, C and D, are illustratively integrated on the inner surface 81 of the bottom 80. In some other embodiments of the present disclosure, another suitable number of electrodes, such as 2, 3, 5, 6, 7, 8 or 9 electrodes, may be integrated on the inner surface 81 of the bottom 80.

In a first implementation, each electrode integrated on the outer surface 82 of the bottom 80 includes at least one through hole 9 (e.g. two through holes as shown) extending through the bottom 80. The through holes 9 may each have a round shape, an oval shape, a square shape, or any other shape and are configured to accommodate conductive material which is electrically connected to a corresponding electrode on the inner surface 81 of the bottom 80 or the conductive upper cover 7. For example, at least one electrode (such as the electrodes E1 and F1 shown in FIG. 5) integrated on the outer surface 82 of the bottom 80 is electrically connected with the conductive upper cover 7 through the conductive material filled in the through holes 9, and at least one electrode (such as the electrodes A1, B1, C1 and D1 shown in FIG. 5) integrated on the outer surface 82 of the bottom 80 is electrically connected with corresponding electrodes (for example, the electrodes A, B, C and D shown in FIG. 6) at the inner surface 81 of the bottom 80 through the conductive material filled in the through holes 9, so that, illustratively, the electrode A is electrically connected to the corresponding electrode A1, the electrode B is electrically connected to the corresponding electrode B1, the electrode C is electrically connected to the corresponding electrode C1, and the electrode D is electrically connected to the corresponding electrode D1.

In a second implementation, the electrodes integrated at the outer surface 82 of the bottom 80 (for example, the electrodes A1, B1, C1 and D1 shown in FIG. 5) are electrically connected with the conductive upper cover 7 or the respective electrodes (for example, the electrode A corresponding to the electrode A1, the electrode B corresponding to the electrode B1, the electrode C corresponding to the electrode C1, and the electrode D corresponding to the electrode D1) at the inner surface 81 of the bottom 80, through a buried or printed conductive layer disposed between the electrodes at the outer surface 82 of the bottom 80 and the conductive upper cover 7 or the corresponding electrodes at the inner surface 81 of the bottom 80. Of course, the way of forming the conductive layer is different from the way of forming a conductive pole by the conductive material filled in the through hole 9 according to the first implementation.

In a variant of the embodiment, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

If the above-mentioned conductive pole in the first implementation is adopted, it should be noted that:

in the case that the insulative base 8 has a layered structure, all the cavity layers of the insulative base above the bottom 80 are provided with through holes 9, which respectively correspond to the through holes 9 in the electrodes integrated at the outer surface 82 of the bottom 80 which are electrically connected to the conductive upper cover 7. When the through holes 9 in all the cavity layers above the bottom 80 and the through holes 9 in the electrodes integrated at the outer surface 82 of the bottom 80 are filled with the conductive material, the conductive upper cover 7 is electrically connected to the corresponding electrodes integrated at the outer surface 82 of the bottom 80. For example as shown in FIG. 7, the through holes in the cavity layers 83, 84 and 85 correspond to the through holes in the electrodes at the bottom 80.

The preferred embodiment of the present disclosure also provides a method for manufacturing an integrated gas discharge tube with a layered structure, and the method includes:

preparing an insulative slurry and casting the insulative slurry to form a green sheet(s) (i.e. a crude sheet(s));

forming a conductive pole or a conductive layer on the green sheet;

printing conductive material and/or cathode emission material on the green sheet which is used as a bottom of the integrated gas discharge tube;

laminating a plurality of the green sheets and sintering and electroplating the laminated green sheets, to form an insulative base of the integrated gas discharge tube; and sealedly connecting an upper cover with the insulative base to form a sealed cavity and filling the cavity with inert gas.

Furthermore, the step of forming the conductive pole on the green sheet includes: punching the green sheet to form a through hole therein and filling conductive material in the through hole.

Furthermore, the step of forming the conductive layer on the green sheet includes: burying or printing the conductive material on a surface of the green sheet.

It is noted that the above-mentioned method for manufacturing the integrated gas discharge tube with a layered structure is suitable for manufacturing not only a single integrated gas discharge tube but also a batch of integrated gas discharge tubes.

When the above method is applied to manufacture a batch of the integrated gas discharge tubes, the step of laminating a plurality of the green sheets and sintering and electroplating the laminated green sheets to form an insulative base of the integrated gas discharge tube includes: cutting the product obtained from the sintering and electroplating of the laminated green sheets, in order to obtain individual insulative bases of the integrated gas discharge tubes.

As understood by those skilled in the art, the method for assembling the integrated gas discharge tube includes, but is not limited to the above-mentioned steps.

An embodiment of the present disclosure also provides a gas discharge tube including: a sealed cavity, which is configured to store inert gas, formed by a cover and an insulative cavity structure that are sealedly connected, where at least one first electrode is attached to an inner wall of the sealed cavity, at least one second electrode is attached to an outer surface of the sealed cavity, and at least one of the at least one second electrode is electrically connected to at least one of the at least one first electrode. Herein, the insulative cavity structure in the embodiment is embodied by the insulative base.

In an optional implementation, one first electrode is attached to the inner wall of the sealed cavity, one second electrode is attached to the outer surface of the sealed cavity, and the second electrode is electrically connected to the first electrode via conductive material filled in a through hole.

In an optional implementation, one first electrode is attached to the inner wall of the sealed cavity, two second electrodes are attached to the outer surface of the sealed cavity, and one or two of the two second electrodes are electrically connected to the first electrode via conductive material filled in the same or different through holes.

Herein, the number of the first electrodes in the sealed cavity and the number of the second electrodes attached to the outer surface of the sealed cavity are not limited to those in the present embodiment.

In the present embodiment, all of the first electrodes share the same sealed cavity storing inert gas. The first electrode and the second electrode which are electrically connected belong to one gas discharge tube in theory. If a plurality of the first electrodes and a plurality of second electrode respectively electrically connected with the first electrodes are attached to the sealed cavity, a plurality of gas discharge tubes are formed in theory and integrated together to share the same sealed cavity, so that when gas discharge is conducted in the integrated gas discharge tube, exchanging and transferring of gas, primary electrons, gas electrons and gas ions is implemented by the plurality of gas discharge tubes. Illustratively, referring to FIG. 10 which is a schematic diagram showing discharge principles of the integrated gas discharge tube according to an embodiment of the present disclosure, through the transferring of electrons and ions in the same cavity, the plurality of gas discharge tubes ignite the whole cavity and trigger one another to operate simultaneously, so that more intensive lighting or a higher overvoltage or overcurrent can be released through the integrated gas discharge tube, and the possibility of damaging the individual one(s) of the plurality of gas discharge tubes is decreased.

Further, in the present embodiment, the common sealed cavity can ensure consistency of operations of the plurality of gas discharge tubes hit by lighting or applied by an overvoltage, and therefore shifting from a common mode to a differential mode due to the inconsistency between discharge tubes can be effectively avoided, thereby protecting subsequent circuits from damages In an optional implementation, the at least one second electrode attached to the outer surface of the sealed cavity includes:

at least one second electrode attached to an outer surface of the insulative cavity structure and/or an outer side surface of the cover and/or an outer top surface of the cover.

In an optional implementation, the at least one first electrode attached to the inner wall of the sealed cavity includes: at least one first electrode attached to an inner surface of the insulative cavity structure and/or a bottom surface of the cover.

In an optional implementation, the cover is made of an insulative material.

In an optional implementation, the cover is made of conductive material, and the at least one first electrode attached to the inner wall of the sealed cavity includes:

at least one first electrode attached to an inner surface of the insulative cavity structure;

the at least one second electrode attached to the outer surface of the sealed cavity includes:

at least one second electrode attached to an outer surface of the insulative cavity structure; and at least one third electrode is attached at the outer surface of the insulative cavity structure and is electrically connected with the cover.

In an optional implementation, the electrical connection of the at least one third electrode to the cover refers to that:

the at least one third electrode is electrically connected to the cover via the conductive material filled in a through hole.

In an optional implementation, the electrical connection of the at least one second electrode to the at least one first electrode refers to that:

the at least one second electrode is electrically connected to the at least one first electrode via the conductive material filled in a through hole.

In an optional implementation, the insulative cavity structure includes a sealing layer, a bottom layer and at least one cavity layer between the sealing layer and the bottom layer, where the sealing layer includes a solder layer for brazing welding at a high temperature or a metal layer for parallel welding. Illustratively, the solder layer is used for brazing welding at a high temperature, that is, after the insulative base is metalized, the metal on the insulative base and the upper cover are brazing welded at a high temperature by using the solder. Alternatively, the solder layer is substituted by the metal layer for parallel welding, that is, after the insulative base is metalized, a metal is welded to the insulative base and used for parallel welding with the upper cover.

In an optional implementation, at least one electrode on the outer surface of the bottom of the insulative base extends to a side wall of the insulative base. For example, as shown in FIG. 3 or 5, the part of the electrode that extends to the side wall of the insulative base is represented by a shadow structure 91 at the lateral side of the insulative base 8. In the present embodiment, the part of the electrode that extends to the side wall is advantageous in that: during the attachment welding of the integrated gas discharge tube, it is possible to detect whether the welding effect is good enough by the soldering tin applied at the side wall, and further the welded integrated gas discharge tube may be easily removed from the welding pad without damage to the integrated gas discharge tube, for the purpose of a subsequent welding thereof, thereby improving the utilization rate of the integrated gas discharge tube.

Some preferred embodiments of the present disclosure have been described as above, but the scope of the present disclosure is not limited thereto, and any equivalent structures or equivalent flow modifications made in light of the description and the accompanying drawings of the present disclosure, which are directly or indirectly applicable to the related technical fields, fall within the scope of the present disclosure.

The invention claimed is:

1. An integrated gas discharge tube, comprising:

an upper cover, and an insulative base with a bottom integrated with a plurality of electrodes, wherein the insulative base has a cavity structure, the upper cover and the insulative base are connected in a sealed manner to form a cavity, the bottom comprises an inner surface and an outer surface, at least one electrode is disposed on the inner surface, at least two electrodes are disposed on the outer surface, wherein the at least two electrodes disposed on the outer surface comprise at least one first electrode and at least one second electrode; and the at least one first electrode is correspondingly connected electrically with at least one of the at least one electrode on the inner surface of the bottom;

wherein the upper cover is conductive, the at least one second electrode is electrically connected with the conductive upper cover, and the at least one first electrode and the at least one second electrode are disconnected; or the upper cover is insulative, at least one common electrode for the electrodes disposed on the inner surface is disposed at a designated position on the cavity structure of the insulative base, the at least one second electrode is electrically connected with the at least one common electrode, and the at least one first electrode and the at least one second electrode are disconnected.

2. The integrated gas discharge tube of claim 1, wherein the insulative base has a layered structure and comprises a bottom, at least one cavity layer on the bottom, and a sealing layer on the cavity layer, and the sealing layer includes a solder layer for brazing welding at a high temperature or a metal layer for parallel welding.

3. The integrated gas discharge tube of claim 1, wherein at least one of the at least one cavity layer is provided with at least one conductive strip extending in a vertical direction or a transverse direction.

4. The integrated gas discharge tube of claim 1, wherein the insulative base has an integral structure and comprises the bottom, a cavity body formed integrally with the bottom, and a sealing layer on the cavity body, and the sealing layer includes a solder layer for brazing welding at a high temperature or a metal layer for parallel welding.

5. The integrated gas discharge tube of claim 4, wherein the cavity body is provided with at least one conductive strip extending in a vertical direction or a transverse direction.

6. The integrated gas discharge tube of claim 1, wherein each electrode disposed on the outer surface comprises at least one through hole which passes through the bottom and filled with conductive material, and at least one of the electrodes disposed on the outer surface is electrically connected with the conductive upper cover via the conductive material filled in the through hole.

7. The integrated gas discharge tube of claim 6, wherein at least one of the electrodes disposed on the outer surface is electrically connected with the corresponding electrode disposed on the inner surface via the conductive material filled in the through hole.

8. The integrated gas discharge tube of claim 6, wherein the through hole filled with the conductive material is substituted by a conductive layer.

9. The integrated gas discharge tube of claim 1, wherein the upper cover is insulative, and at least two electrodes are disposed on the inner surface and are electrically connected with the at least two electrodes disposed on the outer surface, respectively, to form at least two paired-electrodes.

10. The integrated gas discharge tube of claim 1, wherein the insulative base further comprises a metal ring on the solder layer.

11. The integrated gas discharge tube of claim 1, wherein at least one of the electrodes on the outer surface of the bottom extends to a side wall of the insulative base.

12. A method for manufacturing an integrated gas discharge tube, comprising:

preparing an insulative slurry and casting the insulative slurry to form a green sheet;

forming a conductive pole or a conductive layer on the green sheet;

printing conductive material and/or cathode emission material on the green sheet which is used as a bottom of the integrated gas discharge tube;

laminating a plurality of the green sheets and sintering and electroplating the laminated green sheets, to form an insulative base of the integrated gas discharge tube; and sealedly connecting an upper cover with the insulative base to form a sealed cavity and filling the cavity with inert gas;

the bottom comprises an inner surface and an outer surface, at least one electrode is disposed on the inner surface, at least two electrodes are disposed on the outer surface, wherein the at least two electrodes disposed on the outer surface comprise at least one first electrode and at least one second electrode;

and the at least one first electrode is correspondingly connected electrically with at least one of the at least one electrode on the inner surface of the bottom;

wherein the upper cover is conductive, the at least one second electrode is electrically connected with the conductive upper cover, and the at least one first electrode and the at least one second electrode are disconnected; or the upper cover is insulative, at least one common electrode for the electrodes disposed on the inner surface is disposed at a designated position on the cavity structure of the insulative base, the at least one second electrode is electrically connected with the at least one common electrode, and the at least one first electrode and the at least one second electrode are disconnected.

13. The method of claim 12, wherein forming the conductive pole on the green sheet comprises:

punching the green sheet to form a through hole therein; and filling conductive material in the through hole.

14. A gas discharge tube, comprising: a sealed cavity, which is configured to store inert gas, formed by a cover and an insulative cavity structure that are sealedly connected, wherein at least one first electrode is attached to an inner wall of the sealed cavity, at least one second electrode is attached to an outer surface of the sealed cavity, and at least one of the at least one second electrode is electrically connected to at least one of the at least one first electrode;

wherein the cover is made of conductive material, and the at least one first electrode attached to the inner wall of the sealed cavity comprises:

at least one first electrode attached to an inner surface of the insulative cavity structure;

the at least one second electrode attached to the outer surface of the sealed cavity comprises:

at least one second electrode attached to an outer surface of the insulative cavity structure; and at least one third electrode is attached at the outer surface of the insulative cavity structure and is electrically connected with the cover;

wherein the at least one second electrode and the at least one third electrode are disconnected.

15. The gas discharge tube of claim 14, wherein the electrical connection of the at least one third electrode to the cover refers to that:

the at least one third electrode is electrically connected to the cover via the conductive material filled in a through hole.

16. The gas discharge tube of claim 14, wherein the electrical connection of the at least one second electrode to the at least one first electrode refers to that:

the at least one second electrode is electrically connected to the at least one first electrode via the conductive material filled in a through hole.

17. The gas discharge tube of claim 14, wherein the insulative cavity structure comprises a sealing layer, a bottom layer and at least one cavity layer between the sealing layer and the bottom layer, wherein the sealing layer includes a solder layer for brazing welding at a high temperature or a metal layer for parallel welding.

* * * * *